US005259162A

United States Patent [19]

Nicholas

[11] Patent Number: 5,259,162

[45] Date of Patent: Nov. 9, 1993

[54] MULTI-FUNCTIONAL WALL COVER FOR ARCHITECTURAL JOINTS

[75] Inventor: John D. Nicholas, Lawrenceville, Ga.

[73] Assignee: Pawling Corporation, Pawling, N.Y.

[21] Appl. No.: 912,467

[22] Filed: Jul. 13, 1992

[51] Int. Cl.[5] ..... E04B 1/68

[52] U.S. Cl. ..... 52/463; 52/464; 52/468; 52/469

[58] Field of Search ..... 52/394, 395, 460, 463, 52/464, 468, 469

[56] References Cited

U.S. PATENT DOCUMENTS

| | | | |
|---|---|---|---|
| 3,199,258 | 2/1962 | Jentoft et al. | 52/395 |
| 3,331,171 | 7/1967 | Hallock . | |
| 3,372,521 | 3/1968 | Thom . | |
| 3,435,574 | 4/1969 | Hallock . | |
| 3,439,463 | 4/1969 | Matarese | 52/395 |
| 3,481,090 | 12/1969 | Lizee | 52/463 |
| 3,659,390 | 5/1972 | Balzer et al. | 52/464 |
| 3,670,470 | 6/1972 | Thom . | |
| 3,696,575 | 10/1972 | Armstrong . | |
| 3,864,886 | 2/1975 | Thom | 52/469 |
| 4,455,807 | 6/1984 | Ehrlich | 52/464 |

*Primary Examiner*—Carl D. Friedman
*Assistant Examiner*—Christopher T. Kent
*Attorney, Agent, or Firm*—Schweitzer Cornman & Gross

[57] ABSTRACT

The present invention is directed to architectural joint systems, and particularly to an improved multi-functional cover device, arranged to span the gap between two adjacent, spaced apart architectural structures, such as walls or ceilings. The cover system comprisies a multi-functional cover plate element can be secured by a variety of means.

7 Claims, 2 Drawing Sheets

MULTI-FUNCTIONAL WALL COVER FOR ARCHITECTURAL JOINTS

BACKGROUND AND SUMMARY OF THE INVENTION

The present invention is directed to architectural joint systems, and particularly to a novel and improved multi-functional cover device, arranged to span the gap between two adjacent, spaced apart architectural structures, such as walls or ceilings, for example.

In the design of architectural structures, where significant expansion and contraction activity may be expected, and/or where the threat of seismic activity is present, it is desirable to design architectural structures in a manner that provides for predetermined spacing between adjacent structural segments. This provides for a degree of freedom of relative motion between the adjacent segments without causing damage to the structure. Where joints of this type are provided, it is conventional to provide cover means, spanning the open space between adjacent structural units, for both aesthetic and functional purposes.

The present invention is directed to a generally simplified form of wall cover system, comprising a novel multi-functional cover plate element, arranged to span over the open space between two adjacent structural units and to be secured to one or both of them by a variety of means.

Simple slidable cover plate elements are, of course, well known in the art, and a variety of designs have been provided to enable mounting of the cover plates in a convenient and economical way. Inasmuch as the optimum mounting of a cover plate element may vary with different types of structures, manufacturers have been required to carry inventories of several types of cover plates, which imposes significant cost factors, not only with respect to the required production tooling, but also in connection with inventorying of parts and the handling thereof, etc.

In accordance with the present invention, a novel and simplified form of cover plate member is designed for multiple utilization, capable of being mounted and employed in a wide variety of ways. This enables the manufacturer and/or contractor to reduce inventory and handling costs, and simplifies installation at the job site. The cover element of the invention is a unitary, multi-functional extrusion of a material such as aluminum, which incorporates features enabling installation in a variety of ways, depending upon the requirements of the job and/or the preferences of the contractor. The cover plate configuration of the invention enables the plate to be secured by exposed or concealed fastening means, to be secured by a centering device, as well as fixed at one side, and to receive a decorative cover or not, as desired. While the individual functions are, in a general way, individually known, the construction of a single, multi-functional cover element incorporating all of these features, results in significant and unobvious advantages, and enables economies to be realized by both the contractor and the ultimate user.

For a more complete understanding of the above and other features and advantages of the invention, reference should be made to the following detailed description of preferred embodiments of the invention and to the accompanying drawings.

DESCRIPTION OF PREFERRED EMBODIMENTS

Figure 1:
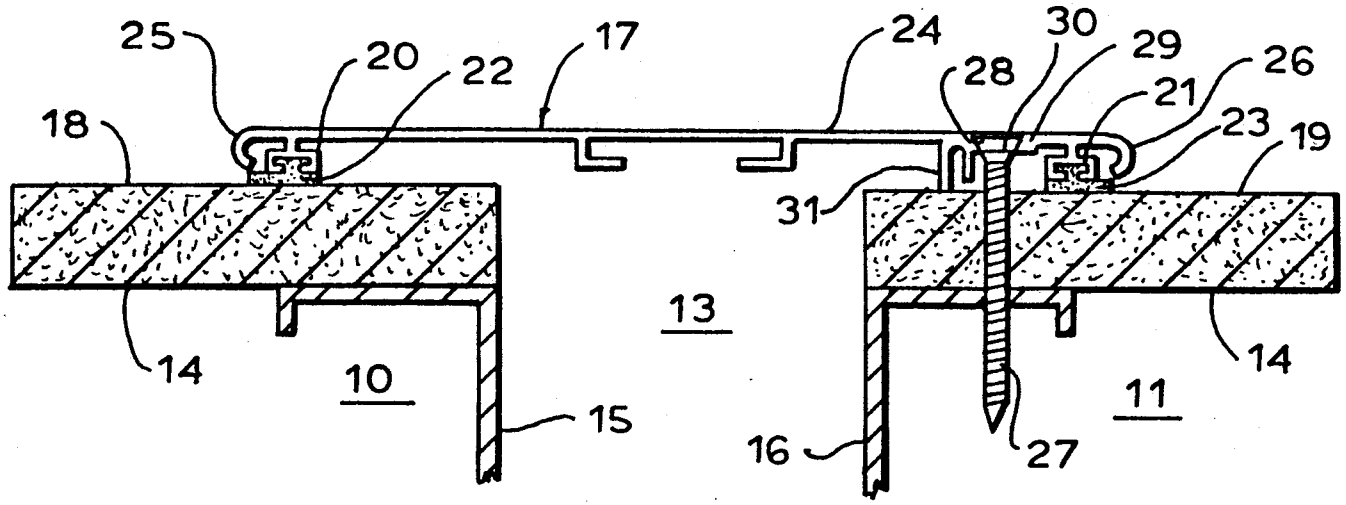
FIG. 1 is a fragmentary cross sectional view of an architectural joint provided with a cover system according to the present invention, which is fixed at one side and slidable at the opposite side.

Referring now to the drawing, and initially to FIG. 1, the reference numerals 10, 11 designate generally a pair of spaced apart architectural units defining a space 13 between them. In the illustration, the architectural units are interior wall or ceiling segments comprising sheet rock panels 14 and metallic studs 15, 16. A cover plate 17, in the form of a continuous extrusion of aluminum or other suitable material, having a uniform cross section throughout, spans over the space 13 between the architectural units. The cover 17 is arranged to contact the outer surfaces 18, 19 of the wall panels 14, and to be slidable with respect to at least one of them.

Adjacent the opposite side edge of the cover 17 there are rearwardly projecting integral channels 20, 21 arranged to receive continuous resilient contact strips 22, 23, providing for a resilient, noise-free contact with the wall panel surfaces 18, 19. The main panel 24 of the cover is preferably generally flat but can be provided with decorative surface features if desired.

The opposite side edge extremities 25, 26 of the cover plate 17 desirably are of generally semi-cylindrical contour oriented to be outwardly convex. The rearward extremities of the semi-cylindrical edges terminate generally adjacent to and approximately at the level of the rearwardly projecting channels 20, 21. In the illustrated arrangement, the resilient contact strips 22, 23 include portions which extend laterally outward to underlie the extremities of the semi-cylindrical edges 25, 26 so that, viewed from the edge, there does not appear to be any significant gap between the edges 25, 26 and the surfaces 18, 19 of the underlying wall board panels.

Pursuant the invention, the cover plate 17 is provided with a variety of combinations of elements for mounting the cover plate usefully with respect to the wall panels 18, 19 and the space 13 therebetween. In the arrangement of FIG. 1, the cover plate is mounted by means of a plurality of screws 27, received in appropriately spaced holes 28 provided in the cover plate. To this end, the cover plate of the invention is provided with an anchoring base section 29, in the form of a strip-like section of the cover plate closely adjacent to and extending longitudinally along one of the rearwardly projecting channels 21. In most cases, the wall thickness of the main panel 24 of the cover plate is relatively thin, and marginally adequate for the retention of the screws 27. Accordingly, the strip-like anchoring base portion 29 desirably is of somewhat greater thickness than the balance of the main cover plate panel 24. While it would of course be possible to make the entire cover plate 17 of sufficient wall thickness to support the mounting screws 27, this would be generally an over design of the cover plate and a wasteful and costly use of materials. Accordingly, the anchor base 29 is most advantageously in the form of a relatively narrow, elongated strip, slightly wider than the head portion 30 of a typical countersunk mounting screw.

To advantage, the cover plate 17 is provided with a support leg 31, projecting rearwardly from the main panel 24 and positioned to lie on the opposite side of the mounting screws 27 from the adjacent contact strip 23. In this manner, the cover plate is supported closely adjacent to, and on opposite sides of, the mounting screws. With this configuration, distortion of the cover plate 24, resulting from overtightening of the screws 27 during the installation process, is minimized or avoided. Significantly, the supporting leg 31 forms part of an alternative mounting feature as will be described hereinafter.

In the mounting arrangement illustrated in FIG. 1, the cover plate 17 is rigidly secured to one of the structural units 11, and relative motion between the structural units 10, 11 results in relative movement between the unit 10 and the cover plate. The width of the cover plate is thus selected so that the overlap at the relatively movable side is sufficient to accommodate the expected separating movements of the structural units 10, 11.

Figure 2:
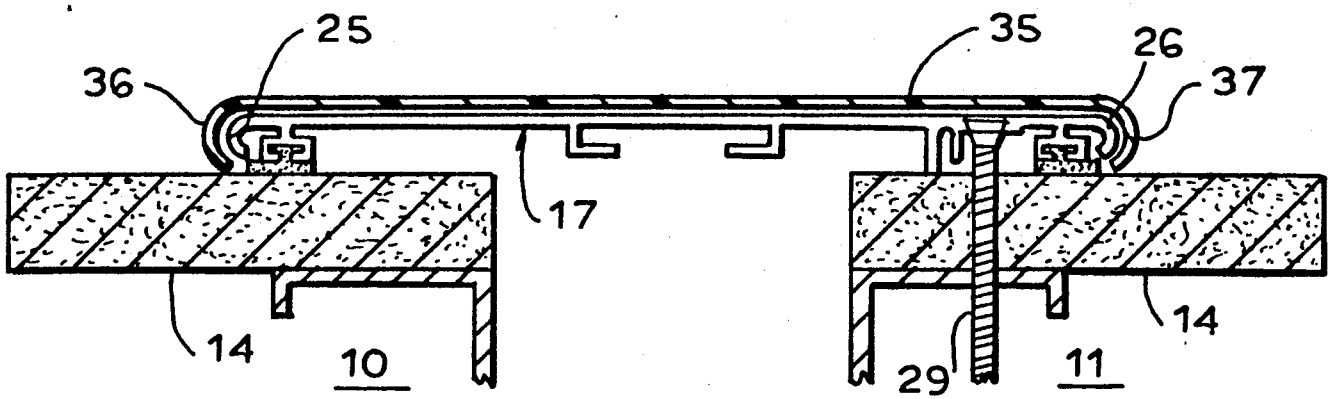
FIG. 2 is a cross sectional view, similar to FIG. 1, but showing the wall cover system employed with a decorative cover.

In FIG. 2, there is shown a form of the invention in which the cover plate 17 is completely covered by a decorative snap-on shell 35, advantageously a continuous extrusion of uniform cross section, formed of a plastic material, such as rigid vinyl. At its opposite side edges 36, 37, the plastic shell is contoured to be of generally semi-cylindrical configuration, with the interior contours of the plastic shell conforming generally to the external contours of the edges 25, 26 of the cover plate. There is sufficient resilience in the rigid vinyl or other plastic material constituting the decorative shell 35, to enable the shell to be forcibly applied over the metal cover plate 17, after mounting thereof on the wall panels 14 of the respective architectural units 10, 11. In a typical installation procedure, one of the semi-cylindrical edges 36 or 37 is hooked over a corresponding edge 25, 26 of the cover plate 17 and then the opposite side edge is forced over its corresponding cover edge until it finally snaps in place in the final position shown in FIG. 2. The use of the cover shell 35 is particularly advantageous when using the mounting arrangement of FIG. 1, for example, because it completely conceals the otherwise visible screw heads 30. However, the plastic shell cover may also be advantageously used in any of the versions of the invention, as it provides for wide flexibility of colors and surface decorations.

Figure 3:
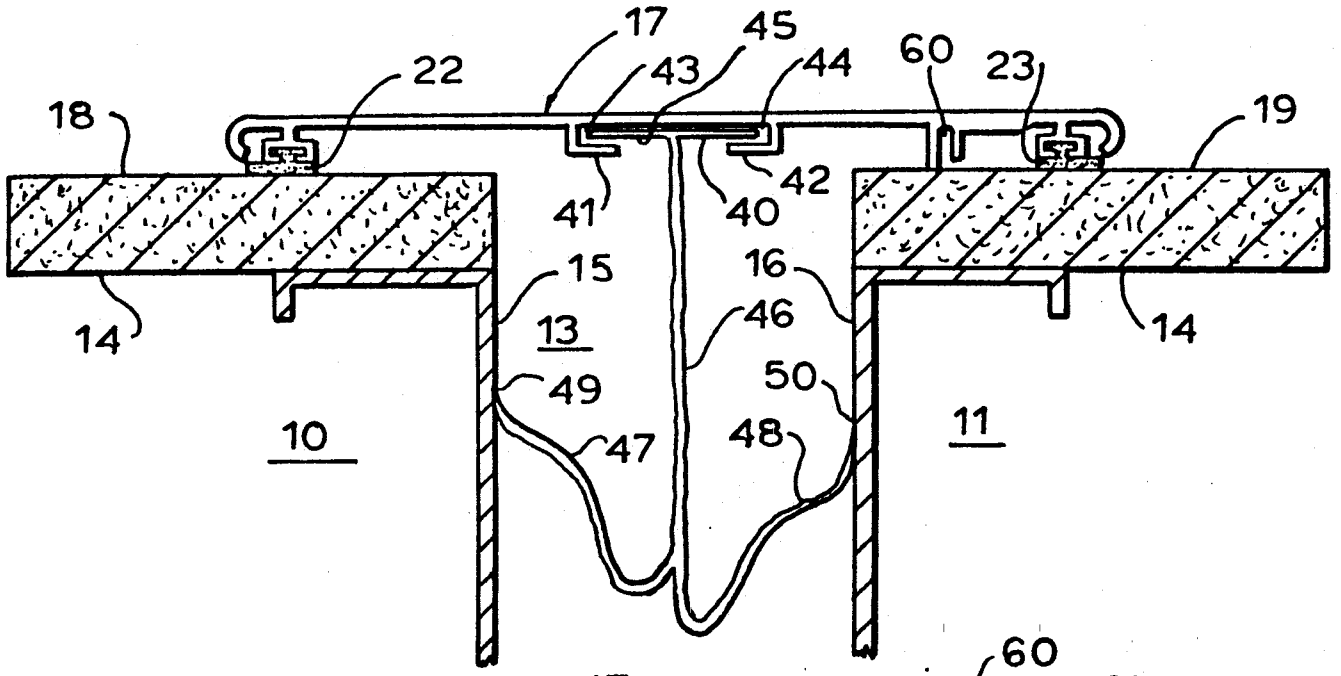
FIG. 3 is a cross sectional view of a modified form of the invention, in which the wall cover system is mounted in the joint in a manner to maintain the wall cover plate substantially centered with respect to the respective adjacent architectural units as they move toward and away from each other.

The arrangement of the invention shown in FIG. 3 incorporates a mounting system accommodating relative motion between the cover plate 17 and the wall panels of each of the structural units 10, 11, in a manner to maintain the cover 17 substantially centered with respect to the open space 13 between the relatively movable architectural units. For this purposes, the multi-functional wall cover element of the invention includes a continuous, rearwardly opening channel 40, formed by spaced apart, opposed generally L-shaped flanges 41, 42 arranged symmetrically with respect to the center line of the cover plate. The L-shaped flanges form opposed, spaced apart, laterally opening recesses 43, 44 arranged for the longitudinally slidable reception of flange portions 45 of a spring clip 46. At its inner end, the spring clip 46 has a normally generally W-shaped configuration, including outwardly and forwardly directed spring legs 47, 48. The spring legs, in their normal orientation have a spacing between their respective outer extremities 49, 50 which is at least somewhat greater than the maximum expected width of the space 13 between the respective architectural units 10, 11.

For installation of the cover plate in the manner illustrated in FIG. 3, a plurality of spring clips 46 are slidably engaged in the channel 40, spaced apart along the length of the cover plate 17 at suitable intervals. Desirably, there is sufficient friction between the mounting portions 45 of the spring clips and the channel 40, that the spring clips will remain substantially in their preset positions during the installation process.

The cover plate, with the spring clips 46 properly spaced, is positioned over the open space 13 and the clips 46 are forced into the space, squeezing inwardly on the spring legs 47, 48. The cover is pushed inwardly until the contact strips 22, 23 are snugly engaged with the outer surfaces 18, 19 of the wall panels 14. Thereafter, the spring clips 46 are self-locking in position, as the end extremities 49, 50 thereof tend to dig into the outer surfaces of the opposed studs 15, 16.

As the structure units 10, 11 move toward and away from each other in the course of expanding and contracting, or for other reasons, the spring legs 47, 48 simply are compressed toward each other or released outwardly, in all cases maintaining contact with the studs 56, at least until the designed limits of expansion have been exceeded. During the expanding and contracting motions, the cover plate 17 will tend to retain itself in more or less centered relation to the space 13 between the structural units, as will be appreciated.

Figure 4:
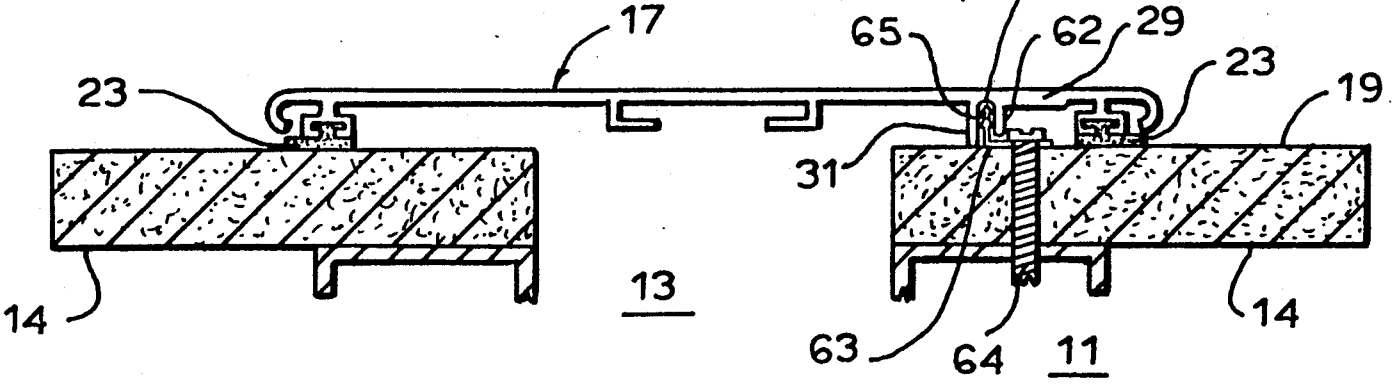
FIG. 4 is a cross sectional view similar to FIG. 1, illustrating the multi-functional wall cover unit as installed by means of a plurality of concealed clips.

In the form of the invention illustrated in FIG. 4, the cover plate 17 is fixed to one of the wall panels and is slidable with respect to the other, in the manner of the installations of FIGS. 1 and 2. In the FIG. 4 installation, however, concealed clips are employed to effect the mounting. In this respect, there is provided adjacent the anchoring base 29 a rearwardly opening continuous U-shaped channel 60, which is defined on the inside by the supporting leg 31, and on the outside by a downwardly projecting flange 62, which is slightly shorter than the supporting leg 31. The internal walls of the U-shaped channel can be serrated if desired.

For mounting the cover plate in the manner of FIG. 4, a plurality of L-shaped clips 63 are secured to the face of the structural unit 11, adjacent to the space 13, by means of screws 64. The L-shaped clips 63 are aligned so that the vertical legs 65 thereof lie substantially in a common plane, at right angles to the surface 19 of the wall board panel 14. A plurality of the L-shaped clips 63 are mounted in suitably spaced relation along the side of the space 13. Thereafter, the cover 17 is pressed over the vertical legs 65 of the clips, until the latter are fully received within the rearwardly opening recesses 60. The L-shaped clips 63 and the recess 60 suitably interact to frictionally retain the cover plate 17 in position, with the contact strips 22, 23 bearing against the surfaces 18, 19 of the wall panels. To this end, the vertical legs 65 of the L-shaped clips may be provided with serrations or barbs, or other means to interengage with the walls of the recess 60. Typically, when the clips 63 are fully received in the U-shaped recess 60, the support leg 31 is in contact with the outer surface 19 of the wall board panel, as reflected in FIG. 4.

If desired, the L-shaped clips may be designed so that the vertical legs thereof comprise a plurality of sections adapted to grip opposite surfaces of a single element projecting rearwardly from the cover.

The multi-functional cover plate of the invention enables the manufacturer and/or contractor to inventory a single part, which can be installed in a wide variety of ways, depending upon the nature of the structure and/or the desires of the architect. Heretofore, the illustrated variety of mounting arrangements has only been provided by utilizing cover plates individually designed for the purpose. With the device of the present invention, surprising and unexpected advantages are realized by providing a cover plate design which is multi-functional and incorporates in a single, inexpensive extrusion all of the facilities necessary to accommodate various mounting arrangements, as well as the optional use of a snap-on plastic cover.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. An architectural joint system including a multi-functional wall cover for bridging and concealing a joint between spaced-apart architectural units, wherein the architectural units have outwardly facing surface portions, and wherein the wall cover is adapted to be secured selectively by threaded fasteners, L-shaped clips, or centering spring clips, and wherein the wall cover can be provided selectively with a decorative shell, which comprises (a) an elongated cover member having a length and being of uniform cross section throughout said length, (b) said cover member having front and rear surfaces and opposite side edge portions, and having spaced-apart contact elements adjacent said side edge portions for engaging said outwardly facing surface portions of the respective architectural units and being slidably movable with respect to at least one of said units, (c) said cover member having a section, located between said contact elements and adjacent one of said contact elements, forming an anchoring base, (d) said anchoring base constituting a first cover member securing means and having an aperture for receiving a threaded fastener, (e) said cover member including at least one integral, rearwardly projecting flange located between said contact elements and adjacent to one of said contact elements, (f) said at least one rearwardly projecting flange constituting a second cover member securing means adapted to receive at least one L-shaped mounting clip, (g) said cover member further including opposed integral L-shaped flanges located on the rear surface of said cover member, generally centrally between said contact elements, and forming opposed laterally opening slots, (h) said opposed integral L-shaped flanges constituting third cover member securing means adapted to receive a centering spring clip, and (i) decorative shell securing means on said cover member including said opposite side edge portions.

2. An architectural joint system according to claim 1, further characterized by (a) the section of said cover member comprising said anchoring base being of increased thickness in relation to adjacent portions of said cover member.

3. An architectural joint system according to claim 1, further characterized by (a) said anchoring base and said at least one rearwardly projecting flange being located adjacent to each other.

4. An architectural joint system according to claim 1, further characterized by (a) the opposite side edge portions of said cover member being of generally semi-cylindrical cross section including downwardly and inwardly directed shell-retaining edge extremities.

5. An architectural joint system according to claim 1, further characterized by (a) said cover member including integral downwardly extending slot-forming flanges at each side edge portion, and (b) resilient contact strips received in and retained by said slot-forming flanges.

6. An architectural joint system according to claim 1, further characterized by (a) said cover member including a second integral rearwardly projecting flange adjacent to said at least one flange and defining therewith a rearwardly opening recess.

7. An architectural joint system according to claim 6, further characterized by (a) one of said rearwardly projecting flanges projecting rearwardly slightly beyond the end of the other of said rearwardly projecting flanges and forming a support leg.

* * * * *